US006883873B2

(12) United States Patent
Haney et al.

(10) Patent No.: US 6,883,873 B2
(45) Date of Patent: Apr. 26, 2005

(54) BENCH

(75) Inventors: Thayne B. Haney, Syracuse, UT (US); Kent Ashby, Logan, UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

(21) Appl. No.: 10/379,214

(22) Filed: Mar. 4, 2003

(65) Prior Publication Data

US 2003/0209934 A1 Nov. 13, 2003

Related U.S. Application Data

(63) Continuation-in-part of application No. 29/160,302, filed on May 8, 2002, now Pat. No. Des. 473,391.

(51) Int. Cl.[7] ..... A47C 7/16

(52) U.S. Cl. ..... 297/452.65; 297/451.8; 297/DIG. 2

(58) Field of Search ..... 297/DIG. 2, 451.8, 297/452.65

(56) References Cited

U.S. PATENT DOCUMENTS

| | | | | | |
|---|---|---|---|---|---|
| 1,271,453 | A | | 7/1918 | Elzey | |
| 1,325,358 | A | | 12/1919 | Elzey | |
| D103,956 | S | | 4/1937 | Rink | |
| D121,462 | S | | 7/1940 | Tabb | |
| D135,777 | S | | 6/1943 | Smith | |
| D152,129 | S | | 12/1948 | Sanford | |
| D153,162 | S | | 3/1949 | Nelems | |
| D154,356 | S | | 7/1949 | Allmand | |
| 2,567,612 | A | | 9/1951 | McGhee | |
| D165,835 | S | | 2/1952 | Glass | |
| 2,845,111 | A | * | 7/1958 | Barecki et al. | 297/DIG. 2 |
| 3,047,334 | A | | 7/1962 | Vanderminden | |
| 3,669,496 | A | * | 6/1972 | Chisholm | 297/452.65 |
| D273,444 | S | | 4/1984 | Harper, Jr. et al. | |
| D281,378 | S | | 11/1985 | Parker | |
| 4,555,140 | A | * | 11/1985 | Nemoto | 297/452.65 |
| D290,911 | S | | 7/1987 | Pomeroy et al. | |
| 4,805,962 | A | * | 2/1989 | Sacco et al. | 297/DIG. 2 |
| D313,515 | S | | 1/1991 | Wood | |
| D325,304 | S | | 4/1992 | Grosfillex | |
| D335,971 | S | | 6/1993 | Hess | |
| D342,629 | S | | 12/1993 | Tseng | |
| D355,783 | S | | 2/1995 | Noll | |
| D369,922 | S | | 5/1996 | Kirn et al. | |
| 5,575,533 | A | * | 11/1996 | Glance | 297/452.2 X |
| 5,667,273 | A | | 9/1997 | Noll | |
| D385,425 | S | | 10/1997 | Goetz | |
| 5,924,771 | A | * | 7/1999 | Marchesi et al. | 297/452.65 |
| D419,004 | S | | 1/2000 | Collins | |
| D419,315 | S | | 1/2000 | Durbin et al. | |
| D423,801 | S | | 5/2000 | Noll | |
| D425,718 | S | | 5/2000 | Van Valderen | |
| D432,323 | S | | 10/2000 | Pomeroy et al. | |
| D434,573 | S | | 12/2000 | Noll | |
| D439,068 | S | | 3/2001 | Vanderbyl | |
| 6,199,950 | B1 | | 3/2001 | Noll | |
| D457,339 | S | | 5/2002 | Liu | |
| D457,342 | S | | 5/2002 | Muller | |
| 6,783,184 | B2 | * | 8/2004 | DiBattista et al. | 297/452.65 X |

FOREIGN PATENT DOCUMENTS

| | | | |
|---|---|---|---|
| JP | 11-318634 | * | 11/1999 |

* cited by examiner

*Primary Examiner*—Anthony D. Barfield
(74) *Attorney, Agent, or Firm*—Workman Nydegger

(57) ABSTRACT

A bench includes a frame that may include a back and seat support portion which is sized and configured to support a bench seat and a bench back. The bench seat and the bench back are preferably constructed from blow-molded plastic. The bench seat and back may include a plurality of depressions that are desirably configured to increase the strength of the bench seat and back. The bench seat and back may also include one or more screw bosses, receiving channels and/or grooves. Desirably, the depressions, screw bosses, receiving channels and/or grooves are formed in the bench seat or bench back as part of a unitary, one-piece construction.

15 Claims, 7 Drawing Sheets

BENCH

CROSS-REFERENCE TO RELATED APPLICATIONS

This application is a continuation-in-part of U.S. Design patent application Ser. No. 29/160,302, filed May 8, 2002 now U.S. Des. Pat. No. 473,391, entitled STATIONARY GARDEN BENCH, which is incorporated by reference in its entirety.

BACKGROUND OF THE INVENTION

1. Field of the Invention

The present invention relates generally to furniture, and more specifically to a bench.

2. Description of Related Art

Benches are well known in the art and it is known to construct benches with a variety of different configurations. For example, benches may include one or more arms or armrests. These arms or armrests may be placed at the outer edges of the bench and one or more arms may be disposed towards the center of the bench. Conventional benches may also include a seat and a back that are integrally formed as a single component, or the seat and back may consist of separate components that are joined together or spaced apart by a distance.

Conventional benches are often constructed from materials such as wood. In particular, the seat and back of many conventional benches are often constructed from a number of wooden boards or slats that are connected to a frame. Disadvantageously, the wood may quickly deteriorate when exposed to the elements. For example, the wood may warp or rot when used outdoors. Additionally, the wood is often limited in strength because it may crack or fracture if over-stressed. Further, the wood must be treated, such as sanding, staining and painting, before use and the wood frequently requires periodic maintenance such as repainting and replacement of broken boards.

Conventional benches may also be constructed from metal. For example, the seat and back portions of the bench may be constructed from metal but these large metal components often rust or corrode over time, especially when the benches are placed outdoors.

Known benches may also include a metal or wooden frame that is used to support the bench seat and back. A large number of screws are typically used to attach the bench seat and back to the frame, especially if the seat and back are constructed from wood. The screws, however, may loosen and require replacement over time. Additionally, connecting numerous boards or components to the frame with screws requires a substantial amount of time, which increases manufacturing time and costs. Thus, conventional benches are often relatively expensive because the benches are constructed from multiple components that are connected by a large number of screws.

Conventional benches are often relatively heavy because they are constructed from materials such as wood and metal. In addition, if the seat and back are constructed from relatively heavy materials such as wood, a heavy and sturdy frame is required to support the heavy wooden seat and back. The heavy seat and back may also require heavier-duty fasteners to connect the seat and back to the frame. Therefore, conventional benches are often undesirably heavy.

These known benches are often expensive to transport and ship because of there relatively large weight. For example, if the benches are being shipped from the manufacturer to a retailer or consumer, the shipping costs of the heavy benches is significant. Additionally, if the consumer purchases the bench at a retail store, such as a hardware store or home center, then the consumer must be able to take the bench home. Consumers, however, may be reluctant to purchase benches that are too heavy to easily transport. For example, many consumers may be unwilling to purchase a bench that is difficult to move to the checkout stand, load into a vehicle and place in a desired location. Additionally, many consumers may want to periodically move the bench. For example, some consumers may desire to use the bench indoors, outdoors or in different locations depending upon the time of the year. A bench that is too heavy, however, may be difficult or impossible for some consumers to move.

Conventional benches may also be shipped in unassembled configurations to reduce the size and bulk of the packaging. While this may reduce the costs to ship the benches, the retailer or consumer may have difficulty in assembling the benches, especially if the benches are heavy. Retailers and consumers may also have difficulty assembling conventional benches because of the multiple components and plurality of screws used to assemble the benches. Accordingly, many consumers may not want to purchase conventional benches because these known benches are often heavy and difficult to assemble.

BRIEF SUMMARY OF THE INVENTION

A need therefore exists for a bench that eliminates the above-described disadvantages and problems.

One aspect of the invention is a bench that can be used in a wide range of situations and environments. For example, the bench could be used indoors and/or outdoors, and the bench may be configured to sit one, two or even more people. Additionally, the bench may include one or more armrests to provide increased comfort for people sitting on the bench. Further, the bench is desirably portable to allow the bench to be easily transported.

Another aspect of the bench is the bench seat and back are preferably lightweight because the seat and back are constructed from plastic. In particular, the bench seat and back are preferably constructed from blow-molded plastic in order to create a lightweight structure. Because the bench seat and back are preferably constructed from lightweight plastic materials, the fame does not have to support a large amount of weight and that may allow a lighter-weight frame to be used. For example, the frame may be constructed from hollow metal tubing and this may allow a bench that is very lightweight to be constructed.

Still another aspect of the bench is the bench seat and back may include one or more depressions, "tack-offs" or "kiss-offs." The depressions, which extend from one surface towards another surface, are desirably sized and configured to increase the strength and/or rigidity of the bench seat and back. Preferably, the depressions extend from one surface and contact or engage an opposing surface, but the depressions do not have to contact or engage the opposing surface. The depressions are desirably formed in the rear surface of the bench back or in the bottom surface of the bench seat so that the depressions are generally not visible. The depressions, however, may also be formed in the front surface and/or other surfaces of the bench seat and back. In addition, one or more depressions may be formed in the rear surface of the bench back and one or more depressions may be formed in the front surface of the back, and these opposing depressions may be aligned. At least a portion of these opposing depressions preferably contact or engage each other, but the opposing depressions do not touch or engage.

Advantageously, the blow-molded plastic bench seat and back are relatively strong because they include two or more opposing walls or surfaces that are separated by a given distance. The opposing walls help create a high-strength, rigid back and seat. Because the interior portions of the bench seat and back are generally hollow, that creates a lightweight back and seat. Significantly, the strong and sturdy back and seat can withstand repeated impacts with various objects and that may allow the bench to be used for an extended period of time.

Significantly, the bench seat and back can be quickly and easily constructed because these components are preferably constructed using a blow-molded plastic process. Advantageously, the blow-molding process allows the double walls and any suitable number of depressions to be quickly and easily formed in the bench seat and back. As discussed above, the double walls and depressions allow a strong and sturdy seat and back to be constructed. These and other features also allow the back and seat to be constructed with relatively thin plastic walls and that reduces the amount of materials used to construct the back and seat. This saves manufacturing costs and reduces the amount of resources required to construct the back and seat. The thin plastic walls also allow the back and seat to be cooled more quickly during the manufacturing process, and that saves time and further decreases costs.

Yet another aspect of the bench is the bench seat and back can be constructed in any desired configuration, shape, size and design depending, for example, upon the intended use and/or configuration of the bench. Significantly, if the bench seat and back are constructed from blow-molded plastic, they can easily be formed into any desired size, configuration, and color. In addition, the blow-molded plastic bench seat and back are durable, weather resistant and generally temperature insensitive. The blow-molded plastic bench seat and back, in contrast to many conventional benches, do not corrode, rust or otherwise deteriorate over time.

Advantageously, because the bench seat and back may be constructed from blow-molded plastic, the seat and back are generally hollow and this allows a bench with a reduced weight to be constructed. Significantly, the lightweight bench can be easily transported, which decreases shipping costs. Additionally, consumers may appreciate the reduced weight because they can much more easily transport and assemble the bench. Further, because the bench seat and back are lightweight, the bench does not require a large or heavy duty frame to support the back and seat.

The blow-molded plastic seat and back allow a strong, rigid and sturdy bench to be constructed. Significantly, the blow-molded bench seat and back may form structural members of the bench, or the back and seat may be supported by the frame. In addition, the blow-molded construction of the bench seat and back may allow other features to be formed in the bench and this may reduce the number of steps required in the manufacturing process, which may reduce the overall cost of the bench. For example, one or more channels may be formed in the seat or back to allow the seat or back to be mounted to the frame, and one or more depressions may be formed in the seat and/or back to increase the strength and structural integrity of the blow-molded components.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further clarify the above and other aspects, advantages and features of the present invention. It will be appreciated that these drawings depict only preferred embodiments of the invention and are not intended to limits its scope. The invention will be described and explained with additional specificity and detail through the use of the accompanying drawings in which.

DETAILED DESCRIPTION OF THE PREFERRED EMBODIMENTS

The present invention is directed towards a bench. The principles of the present invention, however, are not limited to benches. It will be understood that, in light of the present disclosure, the bench disclosed herein can be successfully used in connection with other types of chairs, benches and furniture.

Additionally, to assist in the description of the bench, words such as top, bottom, front, rear, right and left are used to describe the accompanying figures. It will be appreciated, however, that the bench can be located in a variety of desired positions—including various angles, sideways and even upside down. A detailed description of the bench now follows.

Figure 1:
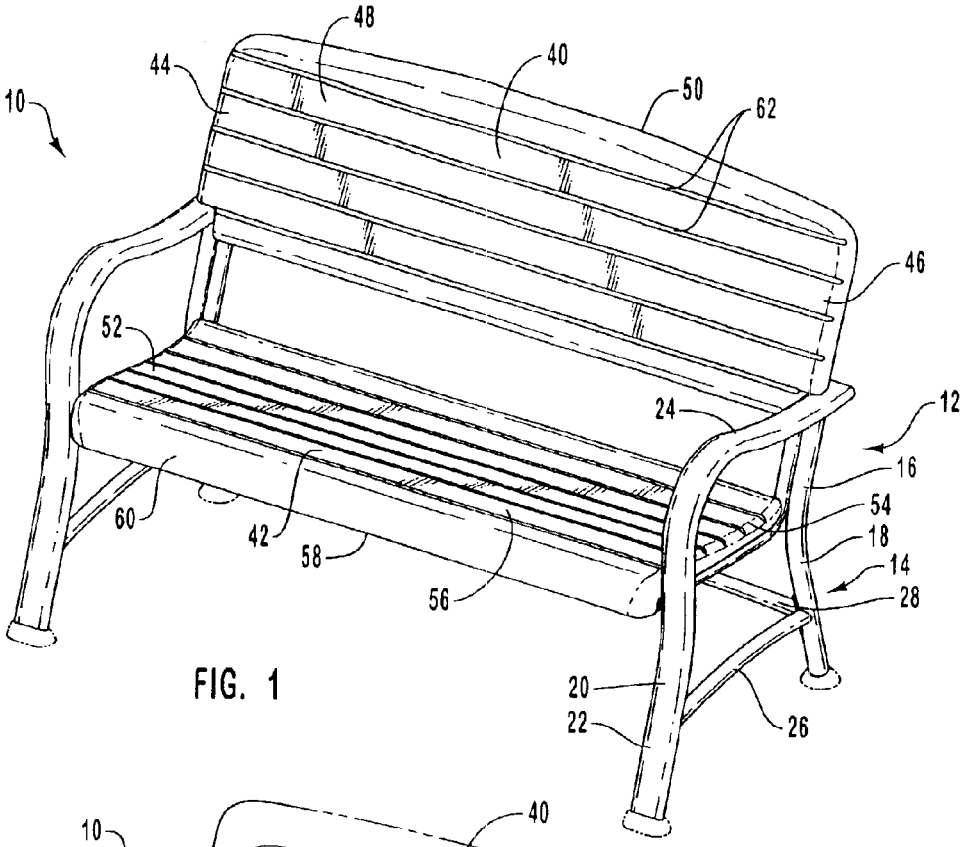
FIG. 1 is a perspective view of a bench in accordance with a preferred embodiment of the invention.
Figure 2:
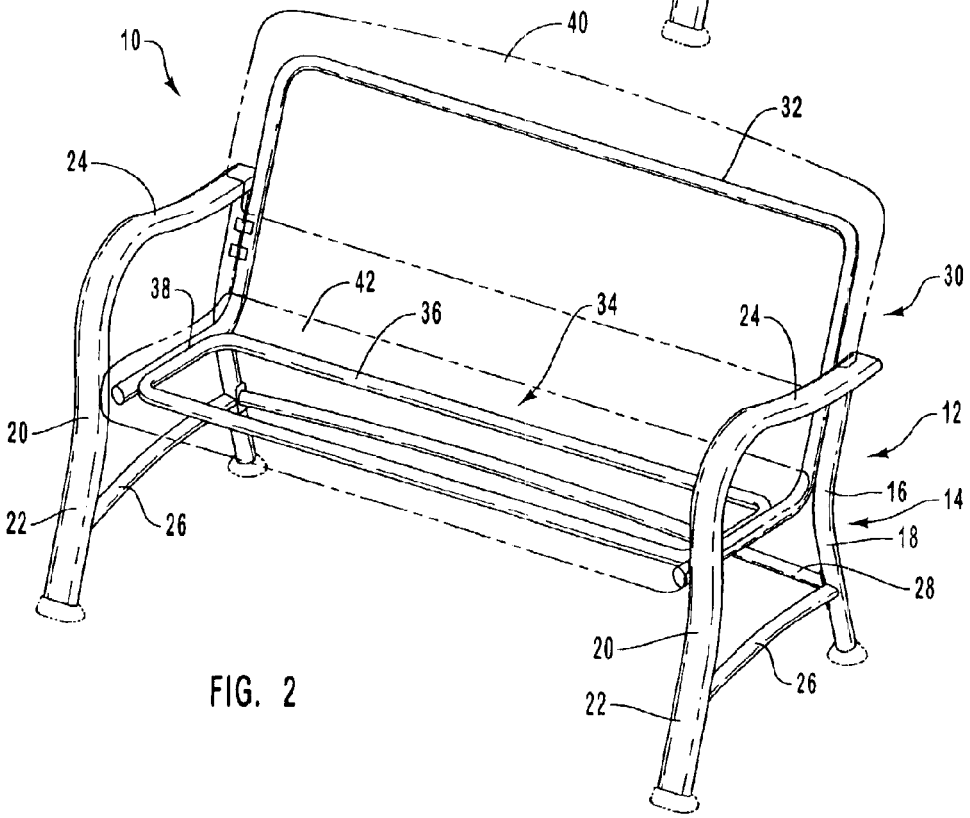
FIG. 2 is a perspective view of the bench shown in FIG. 1, illustrating the seat and back of the bench in broken lines.

As seen in FIGS. 1 and 2, the bench 10 includes a frame 12 and the frame includes a base 14. The base 14 includes two support members 16 that are located near the opposing ends of the bench 10. Each of the support members 16 includes a rear leg 18 and a front leg 20. The rear leg 18 preferably extends generally upwardly and the front leg 20 preferably includes a first portion 22 that extends generally vertically and a second portion 24 that extends generally horizontally. The second portion 24 of the front leg 20 desirably forms an armrest or an armrest support for a user of the bench 10. The end of the second portion 24 of the front leg 20 is desirably attached to the upper end of the rear leg 18 by welding, but it will be appreciated that the front and rear legs may be connected by any suitable means such as fasteners, brackets, adhesives, rivets, bonding, and the like. It will also be appreciated that the front and rear legs 18, 20 may be constructed as a single components or multiple components that are interconnected.

The front and rear legs 18, 20 are preferably interconnected by one or more elongated members in order to create a secure and rigid base 14. In particular, as best seen in FIGS. 1 and 2, an elongated member 26 may connect the rear leg 18 to the front leg 20. Additionally, an elongated member 28 may interconnect the rear legs 18. The elongated members 26, 28 are preferably located towards the lower ends of the front and rear legs 18, 20, but the elongated members could be positioned in any desired location and have any desired configuration. The elongated members 26, 28 are preferably connected to the legs 18, 20 by welding, but the elongated members and legs may be connected by any suitable type of fasteners, brackets, adhesives, rivets, bonding, and the like.

The base 14 is preferably constructed from metal and, in particular, from metal tubes that are bent or formed into the desired shapes and configuration. It will be appreciated that the base 14 may be constructed from other suitable materials and it may have other appropriate shapes and configurations depending, for example, upon the type of materials used to construct the base or the intended use of the bench 10. It will also be appreciated that the base 14 could be constructed from a single, unitary component or multiple components that are interconnected.

The frame 12 may also include a back and seat support 30 that includes a back support portion 32 and a seat support portion 34. The back support portion 32 includes a generally upwardly extending portion with a generally U-shaped configuration and two forwardly extending arms that are connected to the seat support portion 34. The seat support portion 34 includes two elongated support members 36 that are interconnected by two connecting arms 38. Desirably, the seat support portion 34 has a generally rectangular configuration but it will be understood that the seat support portion may have other suitable configurations depending, for example, upon the size and configuration of the frame 12 and/or the bench 10. The seat support portion 34 is preferably welded to the back support portion 32 to create the back and seat support 30, but the seat support portion and the back support portion may be connected in any suitable manner or means. In addition, the back and seat support portions 32, 34 could be constructed from a single or multiple components. Further, the back and seat support portions 32, 34 are preferably constructed from metal and, in particular, from metal tubes that may be bent into the desired shapes and configuration. It will be appreciated, however, that the back and seat support portions 32, 34 may be constructed from any suitable materials and these components may have other appropriate shapes and configurations depending, for example, upon the type of materials used to construct the back and seat support 30 or the intended use of the bench 10. Finally, it will be appreciated that the back and seat support 30 may have other suitable configurations depending, for example, upon the configuration and intended use of the bench 10.

Significantly, the frame 12 of the bench 10 can be constructed with a minimum number of components and it is easy to manufacture and assemble. It will be appreciated, however, that the bench 10 can have other suitable configurations and there are a variety of ways to form and construct the frame 12. Additionally, as discussed above, the frame 12 are preferably constructed from metal and the metal components preferably have a tubular configuration for relatively high-strength and lightweight. These metal components are preferably powder-coated to prevent the metal from rusting or corroding due to environmental factors such as rain or snow. The frame 12 may also be constructed from other materials with suitable characteristics and the shape and configuration of the components may vary depending, for example, upon the type of materials used to construct the components. For example, if the frame 12 is constructed from metal, then these components may have an oval, rectangular, square or other cross-sectional configuration. Additionally, the frame 12 does not have to be constructed with a tubular or hollow configuration and, in contrast, the frame could be formed from solid materials.

Figure 3:
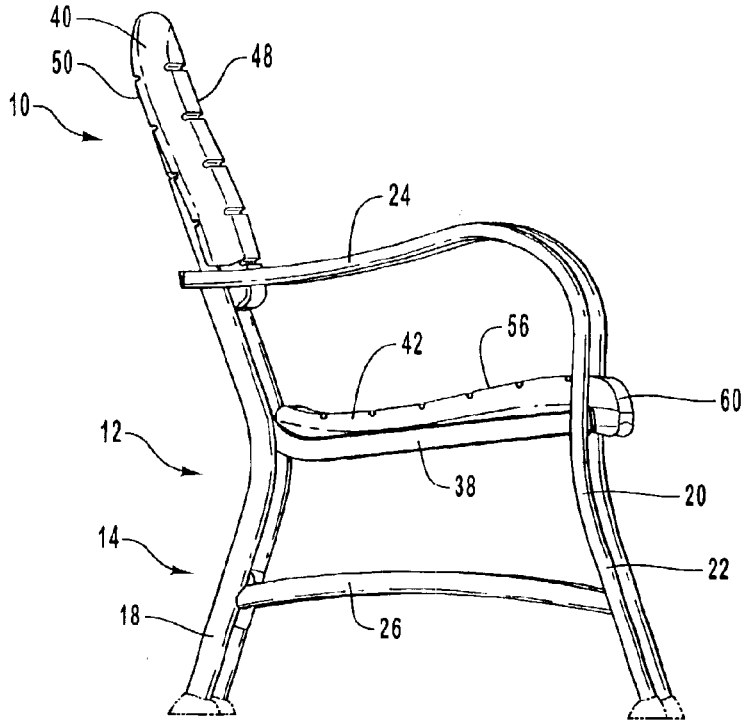
FIG. 3 is a left side view of the bench shown in FIG. 1.
Figure 4:
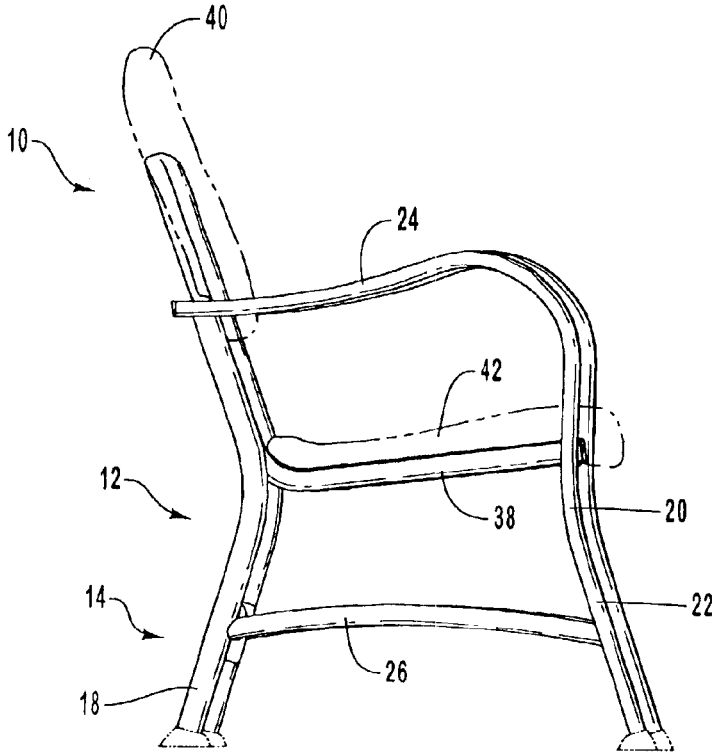
FIG. 4 is a left side view of the bench shown in FIG. 1, illustrating the bench seat and back in broken lines.

As seen in FIGS. 1 and 3, a bench back 40 and bench seat 42 are connected to the frame 12. In particular, the bench back 40 is connected to the back support portion 32 of the back and seat support 30, and the bench seat 42 is connected to the seat support portion 34 of the back and seat support. The bench back 40 includes a first end 44, a second end 46, a front surface 48 and a rear surface 50. The bench seat 72 includes a first end 52, a second end 54, a top surface 56 and a bottom surface 58. It will be appreciated that while the back 40 and seat 42 may include one or more of the following features, the back and seat may include different features and have different configurations.

Figure 5:
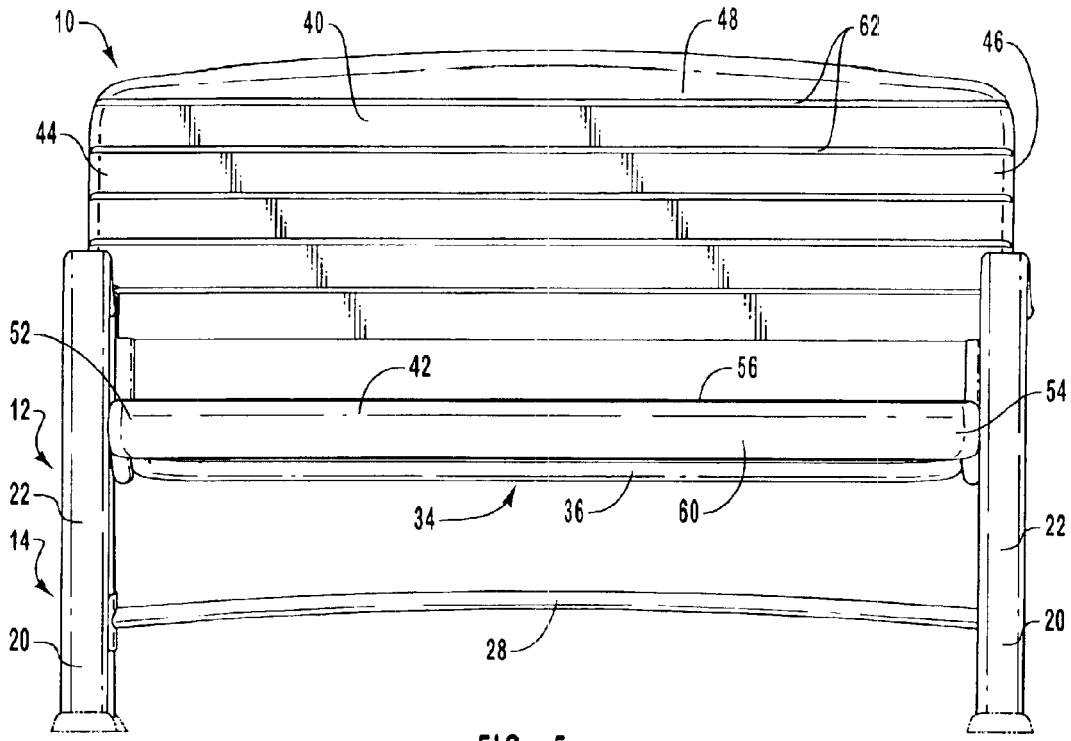
FIG. 5 is a front view of the bench shown in FIG. 1.

As best seen in FIGS. 1 and 5, the bench back 40 and the bench seat 42 each have a generally rectangular configuration with slightly rounded corners and a lip 60 is located on the front of the seat for increased comfort of the users. It will be appreciated that the bench back 40 and the bench seat 42 may have any suitable shapes and configurations depending, for example, upon the size and configuration of the bench 10. Additionally, if desired, the bench back 40 and the bench seat 42 could be a unitary one-piece structure or the back and seat may consist of two or more components that are interconnected or independently attached to the frame 12.

The bench back 40 and the bench seat 42 may also be contoured for increased comfort of the user. In particular, the bench back 40 and the bench seat 42 may be curved to conform to the natural curves of the human body. For example, as seen in FIG. 3, the bench back 40 is curved to provide lumbar support for the user and the bench seat 42 may also be curved to provide a more comfortable, ergonomic position for the user. The seat 42 may also include a downwardly extending front lip to provide increased comfort for the user. Significantly, the contoured bench back 40 and the bench seat 42 may be formed during the manufacturing process, which may save time and costs.

The bench back 40 and the bench seat 42 are preferably constructed from plastic and, in particular, from blow-molded plastic. Advantageously, blow-molded plastic allows a strong and lightweight bench back 40 and bench seat 42 to be constructed. In particular, the blow-molded bench back 40 and seat 42 preferably include two opposing walls or surfaces that are separated by a given distance in order to create a strong and sturdy structure. In addition, the interior portion of the blow-molded bench back 40 and seat 42 are preferably generally hollow. Advantageously, this creates a bench back 40 and seat 42 that are lightweight, strong and rigid, and the back and seat are relatively easy to manufacture. Significantly, because the blow-molded plastic bench back 40 and the bench seat 42 are generally hollow, the back and seat are lightweight. This may allow a lightweight frame 12 to be used to support the bench back 40 and seat 42 because the frame does not have to support heavy back and seat members. Additionally, because the bench back 40 and the bench seat 42 are lightweight, the bench 10 may be easily shipped, transported and moved.

The bench back 40 and the bench seat 42 may be constructed from a variety of different types of plastics with suitable characteristics. For example, the bench back 40 and the bench seat 42 may be constructed from low-density linear polyethylene or a high-density polyethylene with the desired characteristics. Significantly, the blow-molded plastic is generally weather resistant, corrosion resistant and temperature insensitive. This allows a strong, long-lasting bench back 40 and seat 42 to be constructed. Advantageously, the blow-molded plastic bench back 40 and seat 42 generally do not corrode, rust or otherwise deteriorate over time.

The bench back 40 and seat 42 preferably constructed from lightweight, blow-molded plastic because weight reduction of the bench 10 may be desirable. For example, many benches 10 are marketed directly to consumers in retail stores. Thus, the purchaser may be required to bring the bench to a register to be purchased, load the bench into a vehicle, and assemble the bench at home. If the bench back 40 and seat 42 are heavy, then the weight of the bench 10 is increased. If the bench 10 is heavy, that may also require a heavier and more complex support frame which further increases the overall weight of the bench. A consumer may be reluctant to purchase and assemble a bench that is too heavy.

Advantageously, constructing the bench back 40 and seat 42 from lightweight, blow-molded plastic decreases shipping costs, whether shipping the system from the manufacturer to a retailer or consumer. The blow-molded bench back 40 and seat 42 are lightweight and that allows for the overall weight of the bench 10 to be decreased. The lightweight bench back 40 and seat 42 also simplifies the attachment of the back and seat to the frame 12 because the lightweight bench and seat are easy to manipulate and control during the assembly process. Advantageously, because the bench back 40 and seat 42 are lightweight, the frame 12 does not have to support a bench back and seat. This allows the frame 12 to be constructed from lighter weight materials.

Advantageously, the bench back 40 and the bench seat 42 may include multiple features that are integrally formed in the back and seat during the blow-molding process. For example, a plurality of grooves 62 may be formed in the front surface 48 of the bench back 40 and the top surface 56 of the bench seat 42 to create the appearance of wooden slats that are used to create a conventional wooden bench. The front surface 48 of the bench back 40 and the top surface 56 of the bench seat 42 may also be textured, if desired.

One or more receiving channels 64 may also be formed in the rear surface 50 of the bench back 40 and the bottom surface 58 of the bench seat 42 to allow the frame 12 to be attached to the seat and back. Preferably, at least a portion of the receiving channels 64 generally conform to the shape of the corresponding frame 12 so that at least part of the frame may fit snugly into the receiving channel. Additionally, the receiving channels 64 may be sized and configured to receive the frame 12 by a snap, friction or interference fit to securely attach the bench back 40 and the bench seat 42 to the frame. It will be appreciated, however, that the receiving channels 64 may have any desired shape or configuration, and one or more fasteners may be used to in conjunction with the receiving channels to attach the bench back 40 and seat 42 to the frame 12.

Figure 7:
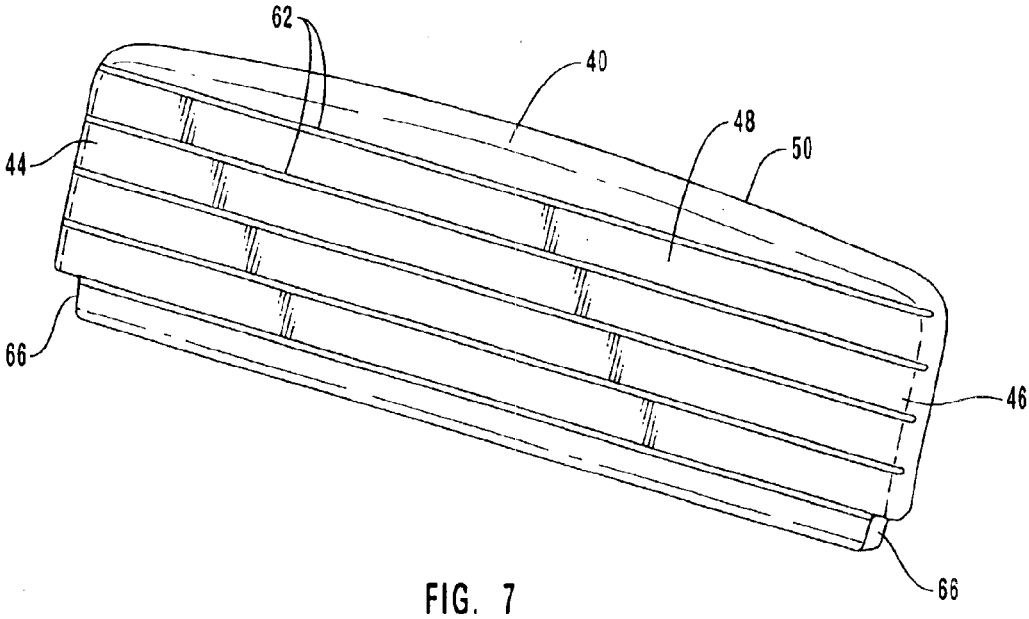
FIG. 7 is an enlarged front perspective view of a portion of a bench in accordance with another preferred embodiment of the invention, illustrating the back portion of the bench.
Figure 8:
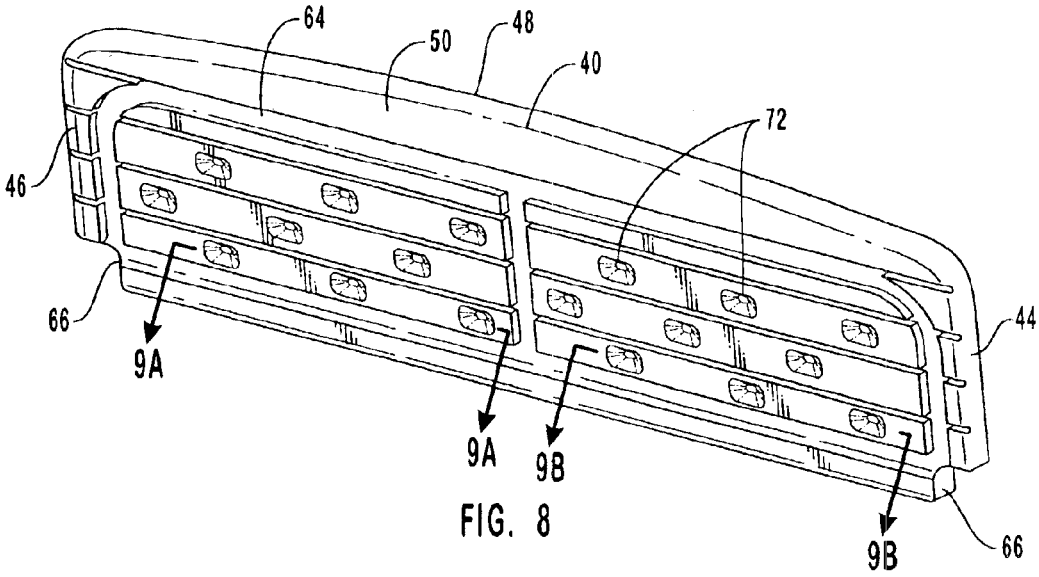
FIG. 8 is a rear perspective view of the bench back shown in FIG. 7, illustrating exemplary depressions in the bench back.

Further, as best seen in FIGS. 7 and 8, the bottom portion of the bench back 40 may include cutouts 66 to assist in mounting the bench back to the frame 12. The bench back 40 and the bench seat 42 may include other features that facilitate attachment of the back and seat to the frame 12. Significantly, these and other features may be simultaneously formed in the bench back 40 and the bench seat 42.

The bench back 40 and seat 42 are preferably constructed as unitary, one-piece structures. Advantageously, this further decreases manufacturing costs and time because one or more components do not have to be assembled or fastened together to form the back or seat. It will be appreciated that the bench back 40 and seat 42 may be constructed as a single member, or by one or more components that are fastened together by any suitable means.

The bench back 40 and the bench seat 42 is attached to the frame 12 by one or more fasteners such as bolts, screws, rivets and the like. It will be appreciated that any suitable type of fastener, adhesives, and the like may be used to attach the bench back 40 and the bench seat 42 to the fame 22. Desirably, the bench back 40 and/or bench seat 42 includes one or more screw bosses 68 to allow a fastener 70 to be connected to the bench back or seat. The fastener 70, for example may be used to attach the bench back 40 or seat 42 to the frame 12. For example, a screw boss 68 may be located in the rear surface 50 of the bench back 40 and it extends towards the front surface 48. The screw boss 68 includes a wall and a distal end that may or may not contact the opposing surface. The screw boss 68 advantageously allows the fastener 70 to be securely attached to the bench back 40. It will be appreciated that the dimensions and size of the screw boss 68 may vary depending, for example, upon the size of the fastener 70 or intended use of the bench 10.

Desirably, in order to provide a secure attachment for the fastener 70, a least two threads of the fastener should engage the wall of the screw boss 68. The thickness of the wall should be sufficient to allow engagement of the threads of the fastener 70 without the threads piercing the wall. It will be appreciated that the thickness and the depth of the screw boss 68 may be a function of the position of the screw boss as well as a function of the load applied to fastener 70.

The screw boss 68 is desirably located in a stretch region of the bench back 40 which allows the screw boss to be formed without piercing the back or creating a portion of the back in which the plastic is too thin. Additionally, the screw boss 68 may be created with an open or closed distal end. These and other features of a screw boss that may be used in conjunction with the bench 10 are described in detail in assignee's co-pending U.S. patent application Ser. No. 10/005,933, entitled Screw Bosses for Blow-Molded Structures, which was filed on Dec. 5, 2001, and is hereby incorporated by reference in its entirety.

Figure 6:
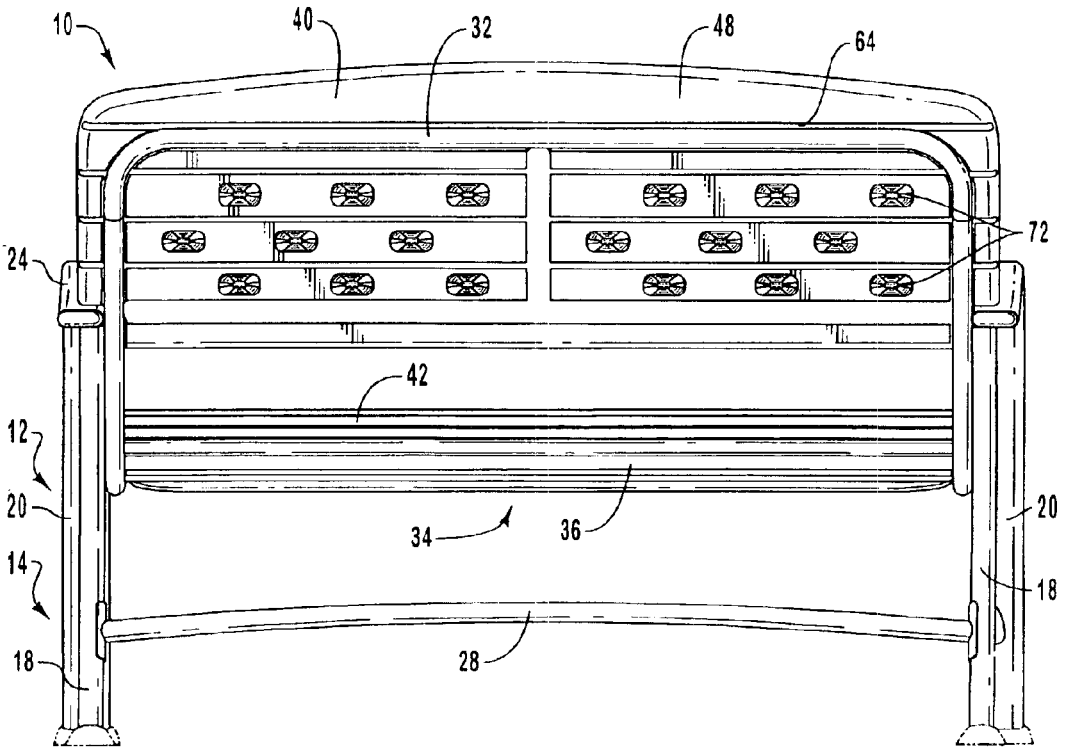
FIG. 6 is a rear view of the bench shown in FIG. 1, illustrating exemplary depressions in the back of the bench.

As shown in FIGS. 6 and 8, the rear surface 50 of the bench back 40 and the bottom surface 58 of the bench seat 42 may include a plurality of depressions 72 or "tack offs." The depressions 72, which extend from one surface towards the other surface, are desirably sized and configured to increase the strength and/or rigidity of the bench back 40 or seat 42. In greater detail, the depressions 72 are desirably formed in the rear surface 50 of the bench back 40 and/or the bottom surface 58 of the bench seat 42 so that the depressions are generally not visible. The depressions 72, however, could be formed in any desired portions of the bench back 40 and/or bench seat 42. For example, one or more depressions 72 may be formed in the rear surface 50 of the bench back 40 and one or more depressions may be formed in the front surface 48 of the bench back, and these opposing depressions are preferably generally aligned. Desirably, at least a portion of these opposing depressions 72 contact or engage each other, but the opposing depressions do not have to touch or engage. One skilled in the art will appreciate that the number, size and location of the depressions 72 may depend upon factors such as the desired strength of the bench back 40 and/or bench seat 42. Further, a portion of the bench back 40 and/or bench seat 42 may include one or more depressions 72 on one surface and one or more depressions in an opposing surface. Finally, the depressions 72 may cover a substantial amount of the rear surface 50 of the bench back 40 and/or the bottom surface 58 of the bench seat 42. The depressions 72, however, may cover only a portion of the rear surface 50 of the bench back 40 and/or the bottom surface 58 of the bench seat 42. One skilled in the art will appreciate that the bench 10 does not require one or more depressions 72.

Figure 9A:
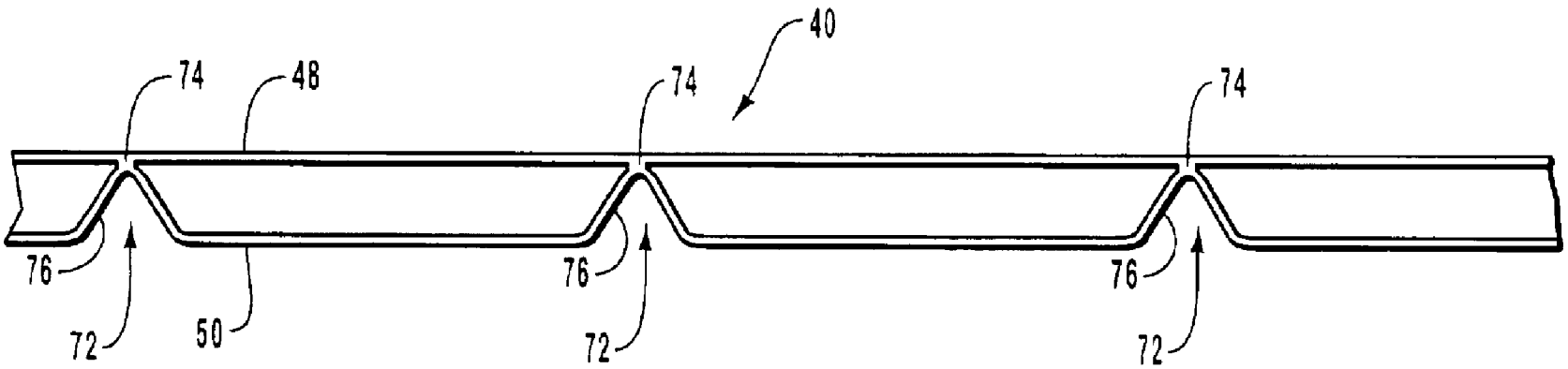
FIG. 9A is an enlarged cross-sectional side view along lines 9A—9A of the bench back shown in FIG. 8, illustrating one embodiment of the depressions.
Figure 9B:
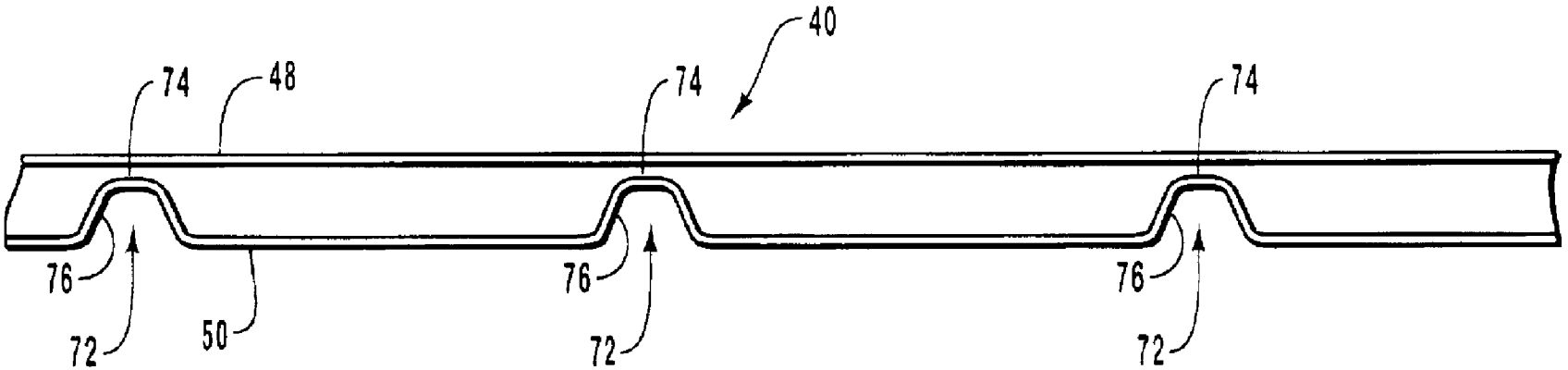
FIG. 9B is a enlarged cross-sectional side view along lines 9B—9B of the bench back shown in FIG. 8, illustrating another embodiment of the depressions.
Figure 10A:
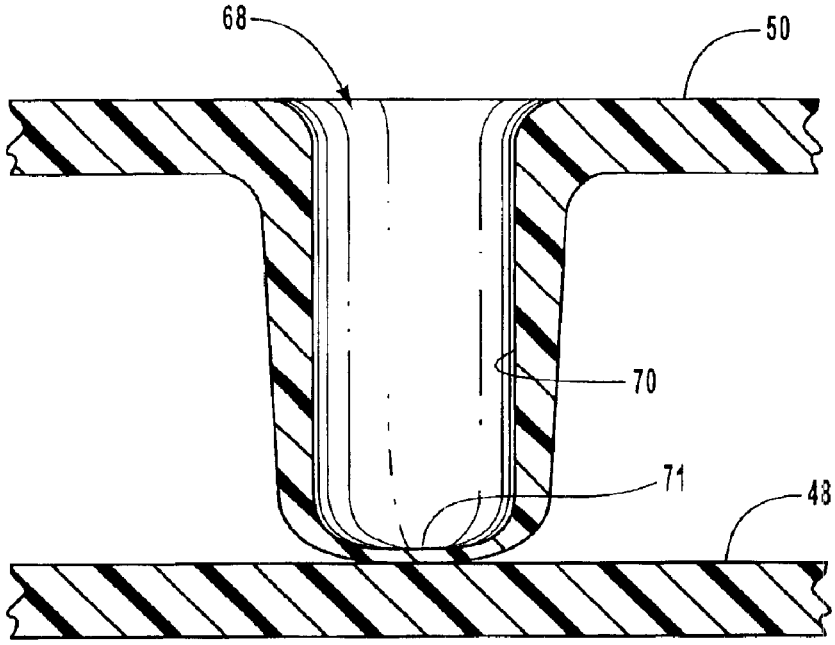
FIG. 10A is an enlarged cross-sectional side view of a preferred embodiment of a screw boss that can be used in conjunction with the bench, illustrating the end of the screw boss contacting an opposing surface.
Figure 10B:
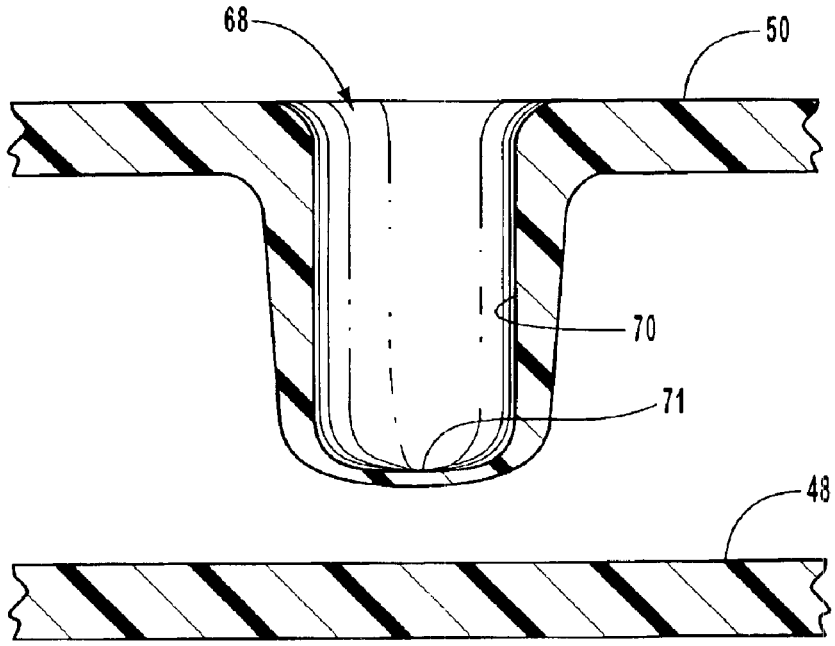
FIG. 10B is an enlarged cross-sectional side view of another preferred embodiment of a screw boss that can be used in conjunction with the bench, illustrating the end of the screw boss being spaced apart from an opposing surface.

The depressions 72 are desirably formed during the blow-molding process and the depressions may be formed by placing a pin in the mold during the blow molding process. The pin causes the plastic material to stretch and deform into the depression 72. For example, a depression 72 may be formed in the rear surface 50 of the bench back 40 and the length of the pin may cause the end 74 of the depression to contact the front surface 48 of the bench back, as illustrated in FIG. 9A. The depression 72, however, may only extend partially into generally hollow interior portion of the bench back 40 and the end 74 of the depression may not contact front surface 48 of the bench back 40, as illustrated in FIG. 9B. Advantageously, because the depressions 72 can be formed during the blow-molding process, that may eliminate a step during the manufacturing process.

Additionally, while the depressions 72 have been described as being formed in the rear surface 50 of the bench back 40, it will be appreciated that depressions may be formed in the front surface 48 of the bench back, the bottom surface 58 of the bench seat 42, and/or the top surface 56 of the seat if desired. Additionally, one or more depressions 72 may be formed on both the front and rear surfaces 48, 50 of the bench back 40 or the top and bottom surfaces 56, 58 of the bench seat 42.

As seen in FIGS. 6 and 8, the depressions 72 preferably have generally tapered walls 76 and the end 74 of the depression may contact or engage the inner surface of the opposing wall. As discussed above, the end 74 of the depression 72 does not have to contact or engage an opposing surface. As shown in the accompanying figures, the depressions 72 preferably have a generally trapezoidal configuration. Advantageously, the trapezoidal configuration provides desirable bearing and torsional characteristics for the bench back 40 and/or seat 42. For example, the trapezoidal shape appears to prevent the bench back 40 and/or bench seat 42 from undesirably bending or yielding.

Advantageously, the blow-molded plastic bench back 40 and/or seat 42 allows the bench 10 to be constructed using a minimum of materials and components. In addition, the blow-molded plastic structures may reduce the number of steps required to construct the bench 10 and may allow the bench to be assembled more easily. Significantly, the transportation, storage, and shipping costs may be greatly reduced because a strong, yet lightweight bench 10 can be constructed. Further, the blow-molded plastic bench back 40 and the bench seat 42 allow the bench 10 to be used indoors and outdoors.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A bench comprising:

a frame including a seat support portion and a generally U-shaped back support portion;

a blow-molded plastic bench seat connected to the seat support portion of the frame; and a blow-molded plastic bench back including a generally U-shaped receiving channel that is integrally formed in the bench back as part of a unitary, one-piece construction, the generally U-shaped back support portion of the frame being disposed within the generally U-shaped receiving channel.

2. The bench as in claim 1, further comprising a plurality of depressions formed in a bottom surface of the bench seat, each of the plurality of depressions including an end that is disposed towards a front surface of the bench seat, the plurality of depressions covering at least a substantial portion of the bottom surface of the bench seat, the plurality of depressions being sized and configured to increase the strength of the bench seat; and a plurality of depressions formed in a rear surface of the bench back, each of the plurality of depressions including an end that is disposed towards a front surface of the bench back, the plurality of depressions covering at least a substantial portion of the rear surface of the bench back, the plurality of depressions being sized and configured to increase the strength of the bench back.

3. The bench as in claim 2, wherein at least a majority of the ends of the plurality of depressions formed in the bottom surface of the bench seat contact the front surface of the bench seat and at least a majority of the ends of the plurality of depressions formed in the rear surface of the bench back contact the front surface of the bench back.

4. The bench as in claim 2, wherein at least a majority of the ends of the plurality of depressions formed in the bottom surface of the bench seat are spaced apart from the front surface of the bench seat and at least a majority of the ends of the plurality of depressions formed in the rear surface of the bench back are spaced apart from the front surface of the bench back.

5. The bench as in claim 1, further comprising at least one groove formed in the front surface of the bench seat, the groove being formed as an integral part of a unitary, one-piece blow-molded plastic bench seat.

6. The bench as in claim 1, further comprising at least one groove formed in the front surface of the bench back, the groove being formed as an integral part of a unitary, one-piece blow-molded plastic bench back.

7. The bench as in claim 1, further comprising a first generally L-shaped member that is connected to the frame to form a first armrest and a second generally L-shaped member that is connected to the frame to form a second armrest.

8. A bench comprising:

a frame;

a first generally L-shaped member connected to the frame to form a first armrest;

a second generally L-shaped member connected to the frame to form a second armrest;

a blow-molded plastic bench seat connected to the frame;

a blow-molded plastic bench back connected to the frame; and a generally U-shaped receiving channel that is integrally formed in the rear surface of the bench back as part of a unitary, one-piece construction, the generally U-shaped receiving channel being sized and configured to receive a generally U-shaped portion of the frame.

9. The bench as in claim 8, further comprising at least one groove formed in the front surface of the bench seat, the groove being formed as an integral part of a unitary, one-piece blow-molded plastic bench seat.

10. The bench as in claim 8, further comprising at least one groove formed in the front surface of the bench back, the groove being formed as an integral part of a unitary, one-piece blow-molded plastic bench back.

11. A bench that is sized and configured to allow two or more people to simultaneously sit on the bench, the bench comprising:

a metal frame;

a generally hollow, one-piece, blow-molded plastic bench seat connected to the frame, the bench seat including a front surface that is spaced apart from a bottom surface, the front surface being continuous and contoured to allow two or more people to sit directly on the bench seat;

a generally hollow, one-piece, blow-molded plastic bench back connected to the frame, the bench back including a front surface that is spaced apart from a rear surface, the front surface being continuous and contoured to allow two or more people to directly contact the bench back;

a plurality of depressions formed in the bottom surface of the bench seat, each of the plurality of depressions including an end that is disposed towards the front surface of the bench seat, the plurality of depressions covering at least a substantial portion of the bottom surface of the bench seat, the plurality of depressions being sized and configured to increase the strength of the bench seat; and a plurality of depressions formed in the rear surface of the bench back, each of the plurality of depressions including an end that is disposed towards the front surface of the bench back, the plurality of depressions covering at least a substantial portion of the rear surface of the bench back, the plurality of depressions being sized and configured to increase the strength of the bench back.

12. A bench that is sized and configured to allow two or more people to simultaneously sit on the bench, the bench comprising:

a metal frame;

a generally hollow, one-piece, blow-molded plastic bench seat connected to the frame, the bench seat including a front surface that is spaced apart from a bottom surface, the front surface being continuous and contoured to allow two or more people to sit directly on the bench seat;

a generally hollow, one-niece, blow-molded plastic bench back connected to the frame, the bench back including a front surface that is spaced apart from a rear surface, the front surface being continuous and contoured to allow two or more people to directly contact the bench back; and a generally U-shaped receiving channel that is integrally formed in the rear surface of the bench back as part of a unitary, one-piece construction, the generally U-shaped receiving channel being sized and configured to receive a generally U-shaped portion of the frame.

13. The bench as in claim 12, further comprising at least one groove formed in the front surface of the bench seat, the groove being formed as an integral part of a unitary, one-piece blow-molded plastic bench seat.

14. The bench as in claim 12, further comprising at least one groove formed in the front surface of the bench back, the groove being formed as an integral part of a unitary, one-piece blow-molded plastic bench back.

15. The bench as in claim 12, further comprising a first generally L-shaped member that is connected to the frame to form a first armrest and a second generally L-shaped member that is connected to the frame to form a second armrest.

* * * * *

UNITED STATES PATENT AND TRADEMARK OFFICE

CERTIFICATE OF CORRECTION

PATENT NO. : 6,883,873 B2
APPLICATION NO. : 10/379214
DATED : April 26, 2005
INVENTOR(S) : Thayne B. Haney and Kent Ashby It is certified that error appears in the above-identified patent and that said Letters Patent is hereby corrected as shown below:

Column 1
Line 67, change “there” to --their--

Column 4
Line 9, change “limits” to --limit--

Column 6
Line 7, before “preferably constructed” change “are” to --is--
Line 26, after “back and seat support” insert --30--
Line 28, after “bench seat” change “72” to --42--

Column 7
Line 22, after “and seat 42” insert --are--

Column 8
Line 3, after “may be used” remove “to”
Line 21, after “bench seat 42” change “is” to --are--
Lines 26/27, change “fame 22.” to --frame 12.--
Line 41, before “least two” change “a” to --at--

Column 11
Line 17, remove claim 11

Column 12
Line 17, change “one-niece” to --one-piece--

Signed and Sealed this

Second Day of October, 2007

JON W. DUDAS
*Director of the United States Patent and Trademark Office*